US007542004B2

(12) United States Patent
Skalina et al.

(10) Patent No.: US 7,542,004 B2
(45) Date of Patent: Jun. 2, 2009

(54) PARASITIC DIPOLE FOR AZIMUTH UNIFORMITY IN BROADBAND ANTENNAS APPARATUS AND METHOD

(75) Inventors: Andre Skalina, Portland, ME (US); John L. Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 314 days.

(21) Appl. No.: 11/415,204

(22) Filed: May 2, 2006

(65) Prior Publication Data

US 2007/0257855 A1 Nov. 8, 2007

(51) Int. Cl.
*H01Q 19/10* (2006.01)
*H01Q 13/10* (2006.01)
*H01Q 21/26* (2006.01)

(52) U.S. Cl. ..... 343/818; 343/770; 343/797

(58) Field of Classification Search ..... 343/767, 343/770, 795, 797, 853, 793, 810–820, 846
See application file for complete search history.

(56) References Cited

U.S. PATENT DOCUMENTS 4,583,098 A * 4/1986 Sikina, Jr. ..... 343/771
5,497,166 A * 3/1996 Mahnad ..... 343/795
6,078,288 A * 6/2000 Adams et al. ..... 342/372
6,762,729 B2 * 7/2004 Egashira ..... 343/767
6,762,730 B2 7/2004 Schadler
2006/0033670 A1 * 2/2006 Schadler ..... 343/767

* cited by examiner

*Primary Examiner*—Shih-Chao Chen
(74) *Attorney, Agent, or Firm*—Baker & Hostetler LLP

(57) ABSTRACT

A horizontally polarized, substantially omnidirectional broadband transmitting antenna uses parasitic dipoles to increase azimuthal circularity over frequency. Because the magnitude of nulls in the field strength increases with frequency, the dipoles are preferentially sized for optimum reradiation at the highest frequency expected for the antenna. For maximum reinforcement of signal strength in the nulls, the longitudinal axes of the dipoles in a preferred embodiment lie in the center planes of the multiple bays of the antenna, are perpendicular to the proximal axes of radiation, and are centered on the nulls. The dipoles are suitable for use with several antenna styles, and are expressly compatible with crossed bowtie slot antennas.

19 Claims, 6 Drawing Sheets

PARASITIC DIPOLE FOR AZIMUTH UNIFORMITY IN BROADBAND ANTENNAS APPARATUS AND METHOD

FIELD OF THE INVENTION

The present invention relates generally to radio frequency electromagnetic signal (RF) broadcasting. More particularly, the present invention relates to techniques for increasing uniformity over frequency in broadband quasi-omnidirectional transmitting antennas having frequency-dependent azimuthal radiative uniformity.

BACKGROUND OF THE INVENTION

In U.S. Pat. No. 6,762,730, entitled CROSSED BOWTIE SLOT ANTENNA, by one of us, filed May 18, 2000, and incorporated by reference with regard to radiator layout and emission properties (hereinafter the '730 patent), a single bowtie slot radiator is disclosed as having a pattern of signal intensity referred to in the art as "peanut" shaped. This term refers to the radiator's characteristic emission in substantially equal nodes (of opposite phase) perpendicular to the faces of the bowtie slot. This emission pattern has nulls, or locations of relatively low signal strength, generally in the plane of the bowtie slot radiator. Where the radiator is oriented as shown in the '730 patent and herein, the polarity of propagation is horizontal, a property required of television broadcast signals by regulation.

As further noted in the '730 patent, when two such radiators are joined at right angles to form a single bay of a crossed bowtie slot antenna, and when the phase angle of the signals applied to the two slots formed thereby is properly chosen, then azimuth uniformity of the emission pattern approaches that of a simple dipole in free space. Each of the radiators has approximately the same nodes and nulls as when standing alone, with little interference between them. Since the nodes of each radiator lie in the plane of the other, the combined bay has four nodes, and the nulls of the combination fall midway between the planes of the two radiators. Stacking multiple bays vertically and energizing the bays with suitable signal strength and phase can increase gain, narrowing beamwidth in the vertical plane. Reinforcement increases reception range parallel to the plane of the earth, while cancellation decreases signal levels directed upward and downward.

An antenna based on this design may perform well, not just at a particular frequency for which the dimensions are optimized, but, by virtue of the features of the '730 patent, including the bowtie slot shape, over a broad frequency range. Indeed, when energized with multiple television channel signals, each having a characteristic bandwidth on the order of 6 MHz and separated in frequency to include guard bands and excluded channels, so that the excitation is distributed over some tens of megahertz, an antenna according to the '730 patent can meet demanding performance criteria.

Nonetheless, it is noteworthy that azimuth uniformity of at least some styles of crossed bowtie slot antennas tends to decrease toward the upper limit of the antennas' working ranges. This decrease has been shown to take the form of reduction in radiative intensity at the nulls noted above, that is, at angles roughly intermediate between signal nodes, with the nulls becoming more prominent with increased frequency. It would be desirable for some broadband applications to provide still greater azimuth uniformity over frequency.

Accordingly, there is a need in the art for increasing crossed bowtie slot antenna signal strength uniformity with azimuth over frequency.

SUMMARY OF THE INVENTION

The foregoing needs are met, to a great extent, by the present invention, wherein an apparatus is provided that in some embodiments provides parasitic radiators at selected locations, thereby increasing crossed bowtie slot antenna signal strength uniformity with azimuth over frequency.

In accordance with one embodiment of the present invention, a transmitting antenna assembly having a radiation pattern with improved azimuthal uniformity over a frequency range is presented. The transmitting antenna assembly includes an antenna having at least one bay, wherein the antenna is configured to radiate with a substantially omnidirectional electromagnetic radiation pattern having one or more nodes and one or more nulls, and a parasitic element positioned within the radiation pattern of the antenna, wherein the parasitic element further comprises a parasitic dipole positioned within the radiation pattern of the antenna, wherein the parasitic dipole selectively alters the antenna radiation pattern, whereby the azimuthal uniformity of the radiation pattern is improved over at least a portion of the frequency range of the antenna.

In accordance with another embodiment of the present invention, a method for transmitting electromagnetic signals with improved azimuthal uniformity over a frequency range is presented. The method includes emitting electromagnetic radiation from at least one bay of an antenna, wherein the electromagnetic radiation emitted therefrom exhibits a frequency-dependent pattern of signal strength versus azimuth, wherein exists a substantially planar surface of maximum emission from the at least one bay, and altering the pattern of emitted radiation with a parasitic element positioned within the radiation pattern of the antenna, wherein the parasitic element selectively improves azimuthal uniformity of the radiation pattern over at least a portion of the frequency range of the antenna.

In accordance with yet another embodiment of the present invention, a transmitting antenna assembly having a radiation pattern with improved azimuthal uniformity over a frequency range is presented. The assembly includes driven means for emitting electromagnetic radiation from at least one bay, wherein the electromagnetic radiation emitted exhibits a frequency-dependent pattern of signal strength versus azimuth, wherein there exists a substantially planar surface of maximum wave emission from the at least one bay, and parasitic means for selectively altering a radiation pattern of the driven means for emitting, wherein at least one parasitic means for emitting interacts with the driven means for emitting.

There have thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. It is also to be understood that the phraseology and terminology employed herein, as well as the abstract, are for the purpose of description, and should not be regarded as limiting.

As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
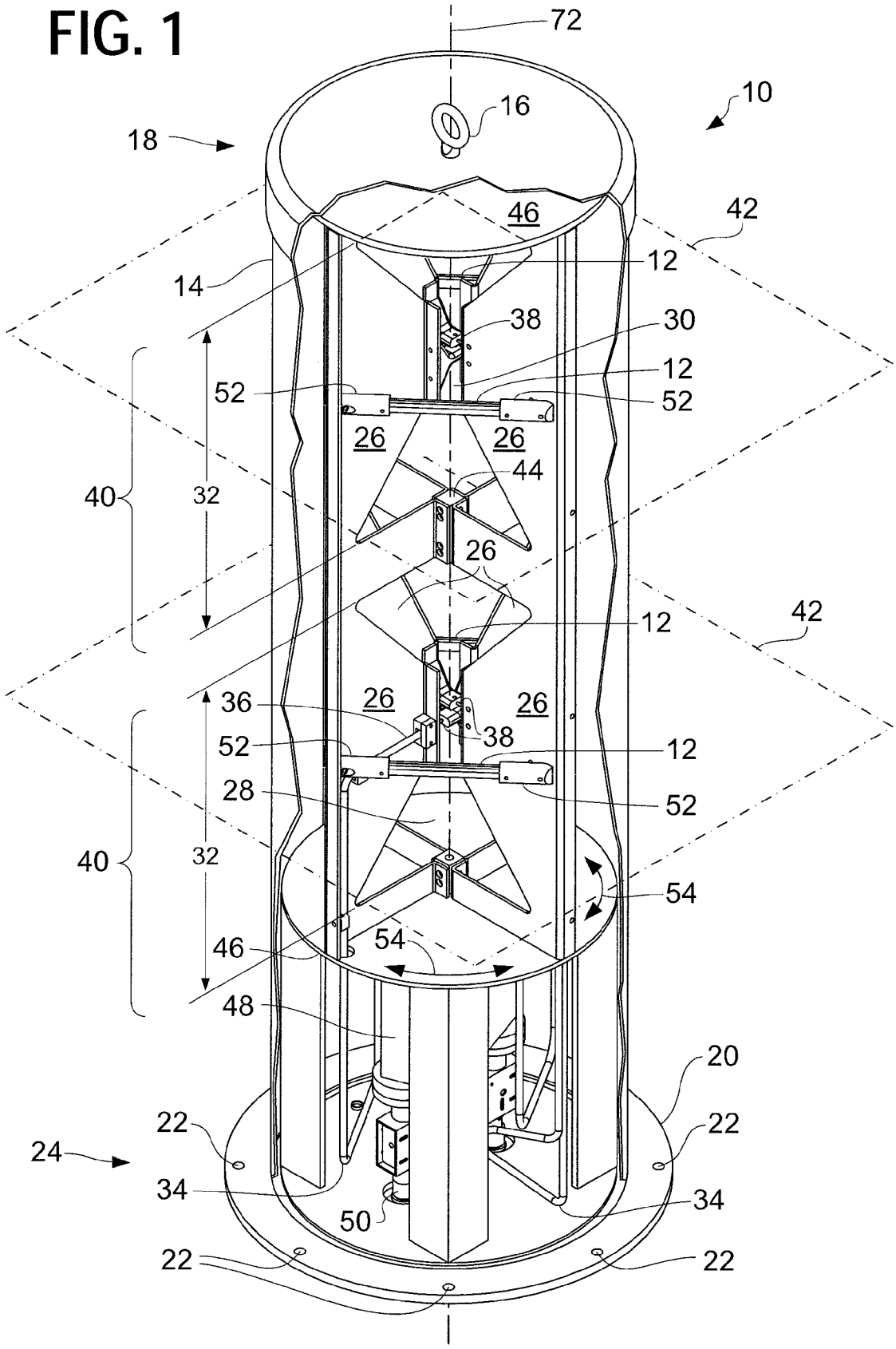
FIG. 1 is a perspective view of an antenna according to one embodiment of the instant invention.

The invention will now be described with reference to the drawing figures, in which like reference numerals refer to like parts throughout. Where multiple parts within a figure have the same reference numeral, a single such part may be so labeled where appropriate. The present invention provides an apparatus and method that in some embodiments provides a broadband crossed bowtie slot broadcast antenna wherein parasitic dipoles increase emission pattern circularity over frequency.

Crossed bowtie slot antennas in accordance with the '730 patent can exhibit desirable ruggedness, power handling, compact size, compatibility with a range of mounting and driving methods, scalability, and compatibility with enclosure within radomes.

Scalability, as the term is used herein, refers to feasibility of adjusting the physical dimensions of an antenna for compatibility with specific, dimension-related requirements such as combined transmitter power level, center frequency, and frequency range. As discussed in the '730 patent and as proven in practice, crossed bowtie slot antennas can be practical in various forms over a relatively wide range of frequencies, including at least the full extent of the ultrahigh frequency (UHF) commercial television broadcast bands.

At higher frequencies, such as in the UHF range, as dimensions of radiating elements decrease, it can prove desirable to enclose antennas within housings, such as radomes, that are substantially RF-transparent and weatherproof. Radomes can provide mechanical protection for relatively fragile components, can increase safety levels by blocking unwanted access to high frequency, high voltage electrical signals, and can effectively reduce accumulation of conduction- and reflection-promoting contaminants proximal to interelectrode gaps such as slots and feed lines. Radomes can also provide mounting, support, and stiffening for some antenna assemblies.

FIG. 1 shows an embodiment of a crossed bowtie slot antenna 10 with parasitic dipoles ("parasitics") 12. The embodiment is shown housed within a radome 14. The antenna 10 has a lifting eye 16 at the top 18 and a mounting flange 20 equipped with mounting holes 22 at the base 24. The blade segments 26 making up the conductive planes of the antenna establish bowtie-shaped slots 28. The slot gaps 30 have narrow parallel regions near the slot 28 centers, and widen toward the slot 28 maximum extents 32. In the embodiment shown, each bowtie slot 28 is driven by a coaxial signal line 34, with the coax outer conductor 36 electrically bonded to a first side of the slot gap 30 and the coax center conductor 38 similarly bonded to a second side of the slot gap 30. Two coaxes 34 feed each crossed bowtie bay 40, with the two coaxes 34 positioned respectively above and below center planes 42 that coincide with the midpoints of the slot gaps 30. The coax separation is selected to largely prevent shorting, arcing, and corona over the working voltage range without degrading slot 28 excitation.

Particular features of this embodiment are distinct from features shown in some of the embodiments presented in the '730 patent. For example, the specific embodiment shown has two bays 40, indicating comparatively low antenna gain, suitable for some applications. Also, the embodiment shown has flat sheet metal blade segments 26, bent to form a slot gap 30 that includes relatively wide facing edges. Other bends provide faces for attaching the blade segments 26 to the indicated style of assembly fittings 44. Conductive wafers 46 above and below the blade segments 26 enhance electrical isolation of the radiative portion of the antenna 10.

Below the lower wafer 46 in the embodiment shown is a hybrid/power divider 48, a device to accept at least one high-level broadcast signal from at least one input fitting 50 and provide a plurality of output lines in support of a branch feed arrangement, such as the four coaxial lines 34 in the two-bay embodiment shown. The hybrid/power divider 48 output coaxial lines (coaxes) 34 each carry a portion of the input signal, properly adjusted in phase with respect to the other signal portions to radiate efficiently. Where conventional omnidirectional radiation with maximized gain for the number of bays 40 is desired, the signals are typically orthogonal (i.e., excited at 90 degree intervals) within a bay 40, as explained in the '730 patent, and, in branch fed antennas, are typically substantially equal in amplitude and phase to signals applied to corresponding slots 28 in other bays 40.

The coaxes 34 may be of equal length in some embodiments, whereby signals are presented to the slots 28 with substantially uniform propagation delays, which may optimize broadband uniformity. In other embodiments, lengths of some of the coaxes 34 may differ from others, for example, by a wavelength, so that propagation time to the slots 28 is made somewhat frequency dependent. This can add variation in the phase relationship between slots 28 and thus beam directionality and/or tilt over the working frequency range for the antenna 10. Coax 34 length variation may be dictated by hybrid/power divider 48 port layout, available space, or another consideration. In typical embodiments, a combination of hybrid/power divider 48 configuration and coax 34 length will be selectable that permits the slots 28 in each bay to be substantially orthogonal and that permits the four emission nodes from that bay 40 to exhibit a so-called mode 1 (90 degree phase progression around the antenna per node) pattern of emission over a wide range of frequencies.

Alternative embodiments may achieve comparable performance while differing significantly in detail, such as by using blade segment 26 materials other than cut and bent sheet metal, by using more or fewer bays 40, by using series feed rather than branch feed, and other differences. Slot 28 shape, including slot gap 30 dimensions, slot height 32, details such as slot 28 edge segment angle and linearity, and the like, can affect propagation characteristics such as broadband emission and impedance uniformity, usable frequency range, and power capacity. For the embodiment shown, wherein compact physical size is a consideration, the lowest usable frequency $f_{min}$ is established in part by slot height 32, with distances between bay center planes 42 set at one wavelength at $f_{min}$ and at least some conductive material bounding the bowtie slots 28. For other embodiments, slot height 32 and one-wavelength spacing may not be limiting factors.

The parasitics 12 are attached to the antenna 10 of FIG. 1 using insulating mounting fittings 52 to position the parasitics 12 across each quadrant 54 of the bays 40. Details of fitting 52 design are broadly optional, with considerations including at least dielectric withstand voltage, creep length, dielectric constant, dissipation factor, yield strength, thermal range, and attachment method left to designer preference.

Figure 2:
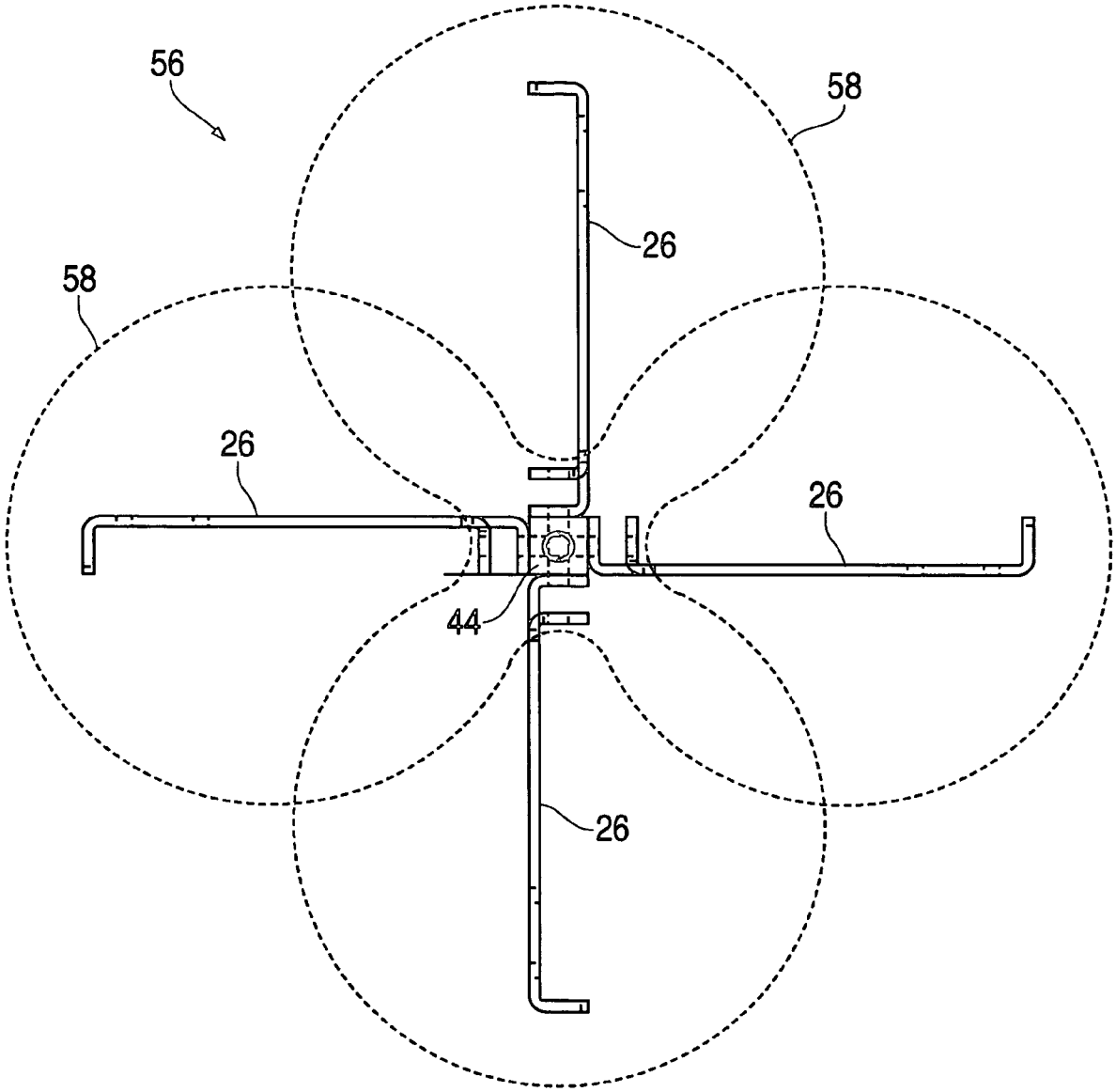
FIG. 2 is a cross sectional view of an antenna according to the '730 patent, and thus illustrates a predecessor of the antenna of FIG. 1.

FIG. 2 shows a section 56 from above of an antenna according to the '730 patent, wherein blade segments 26 and assembly fittings 44 are positioned substantially as shown in the embodiment of the instant invention shown in FIG. 1. The dashed "peanut" shaped nodes 58 for the individual bowtie slots represent the overlapping radiation patterns for the crossed antenna panels. The antenna of FIG. 2 is substantially the antenna 10 of FIG. 1 with the parasitics 12 omitted.

Figure 3:
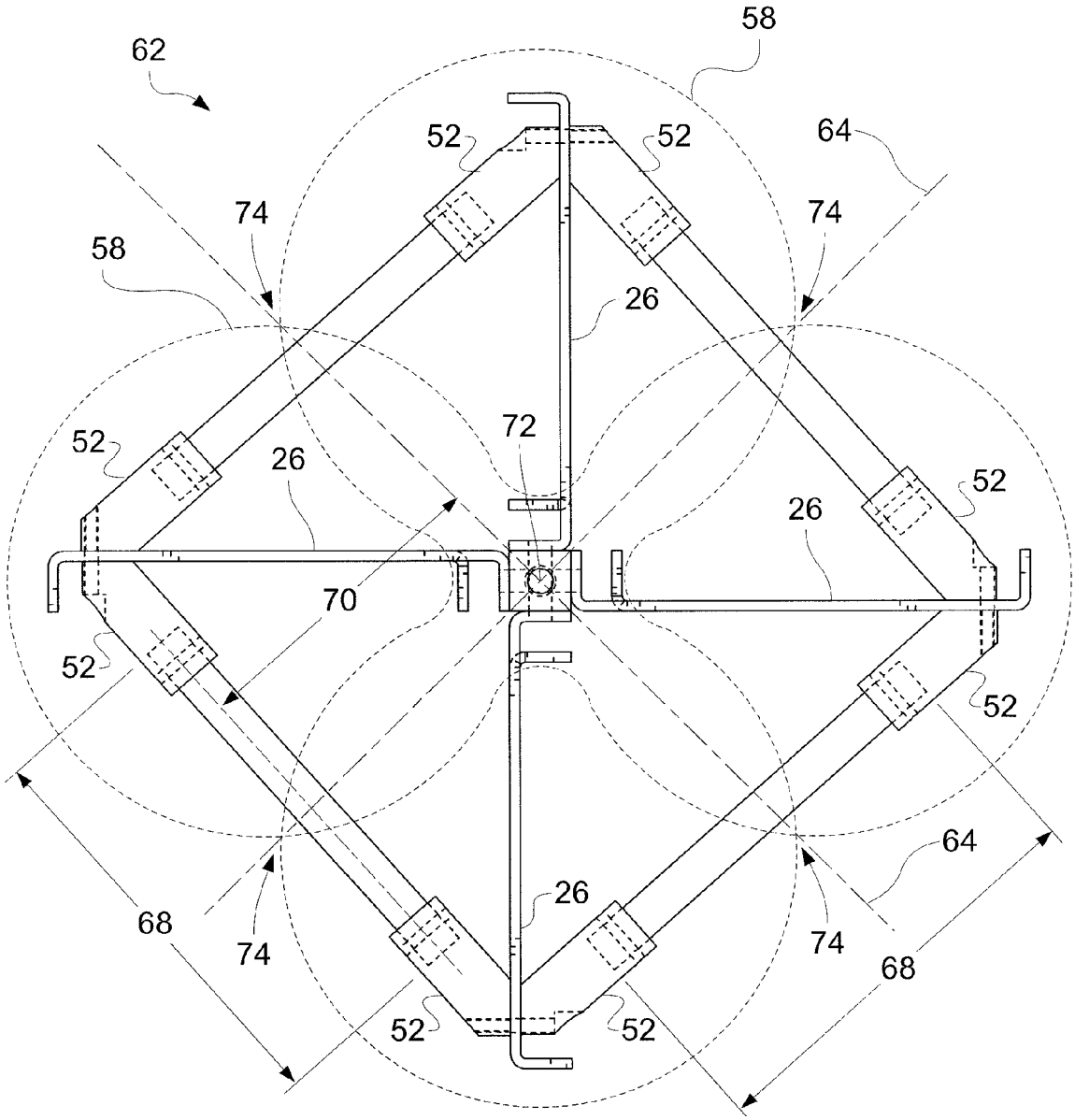
FIG. 3 is a cross sectional view of the antenna of FIG. 1.

FIG. 3 shows a section 62 from above of the antenna of FIG. 1, wherein the blade segments 26, parasitics 12, and insulating mounting fittings 52 are positioned substantially as shown in FIG. 1. The dashed "peanut" shaped nodes 58 for the individual bowtie slots represent the overlapping radiation patterns for the crossed antenna panels. The parasitics 12 are shown to have orientations intermediate between the orientations of the individual blade segments 26, that is, where construction lines 64 in the bay center planes 42 of FIG. 1 intersect at the antenna center axis 72 and bisect the angles between the peak emission nodes 58, the parasitics 12 in the embodiment shown are generally perpendicular to and bisected by the construction lines 64.

A feature differentiating the instant invention from antennas according to the '730 patent is the provision of parasitics 12 in the radiation fields of the bowties 28 in FIG. 1. The parasitics 12 in the embodiment shown are mounted to the blade segments 26 using dipole-mounting insulators 52 (also shown in FIG. 1). Primary attributes of the parasitics 12 that may be distinct for each application include dipole length 68 and distance 70 from the antenna centerline and axis of symmetry 72. Dipole length 68 affects the extent to which node 58 energy from the bowtie slots 28 in FIG. 1 is coupled into the parasitics 12. A useful dipole length 68 can be roughly a half wavelength (in air) of the highest frequency for which the antenna is intended. This length 68 makes the parasitics 12 most efficient as signal couplers at the highest frequency, with efficiency decreasing largely continuously with frequency.

Radiation nulls 74 in the propagation pattern of an equivalent crossed bowtie antenna without parasitics 12 are deeper closer to the top end of the working frequency range. Parasitics 12 that capture and reradiate signals most efficiently at the top end, that reradiate with substantially the same polarization as the main antenna, and that are oriented with respective radiation planes directed toward the nulls 74, can be shown both analytically and experimentally to be capable of improving overall field circularity. Distance (in wavelengths) 70 to the parasitics 12 affects reradiated signal strength, with excitation from the two adjacent orthogonal nodes establishing differential voltage and thus current on the surface of each parasitic dipole 12.

Additional attributes can affect overall performance in some embodiments. One such attribute is placement of the parasitics 12 for each bay 40 in the plane 42 of the electrical centers of the slots 28, which plane is perpendicular to the axis of symmetry 72 of the antenna 10, and passes approximately through the midpoints of the slot gaps 30 shown in FIG. 1, so that the parasitics 12 are in the general locus of highest energy concentration and are positioned to reradiate with maximally reinforcing polarization. Another such attribute is parasitic dipole 12 surface conductivity, wherein parasitics 12 can be made from silver, copper, aluminum, steel, or another adequate conductor or alloy. Where skin effect lowers current penetration, high-conductivity plating or a composite structure such as a metal-clad insulator may be suitable in place of an all-metal conductor such as a copper rod or tube. Another such attribute, dipole shape, can have significant influence on performance, particularly where the shape is irregular or is so dimensioned as to sustain standing waves along axes not in the bay center planes 42 and not perpendicular to the primary (radial) propagation direction. Perforated or expanded material, mesh, channel, wavy material (much less than a wavelength per wave), bent or arcuate dipoles, and the like may be considered for effects they have on overall performance. Small-radius edges, such as the boundaries of a flat plate used as a parasitic, may lower corona threshold.

Dipoles 12 that are tilted or are otherwise shifted from the default locations referenced above may cause the overall antenna radiation pattern to be altered. Dipoles 12 displaced from the bay center planes 42, having thereby a longer net signal path, may have reduced or delayed reradiation, so that the resultant signal component is delayed in phase; and may have a reduced or even a net negative contribution to the combined null fill in some embodiments. Such a function may be useful where a nonuniform radiation pattern is desired. Dipoles 12 rotated out of the respective bay center planes 42 will in general have a signal component with polarization that is not horizontal, and is thus lost to the broadcast pattern of interest. Dipoles 12 having long axes not perpendicular to the principal radiation vectors at their centers may reradiate away from the nulls, and thus likewise alter the overall radiation pattern.

Figure 4:
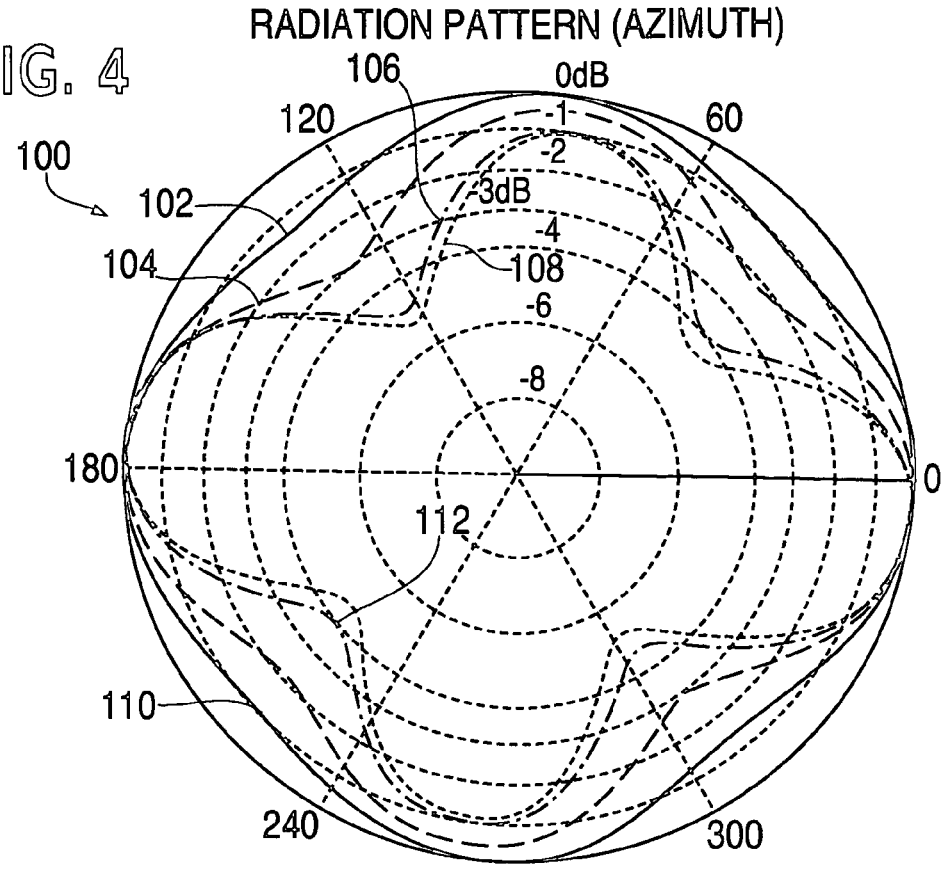
FIG. 4 is a chart indicating signal strength versus azimuth and frequency for an antenna according to the '730 patent.
Figure 5:
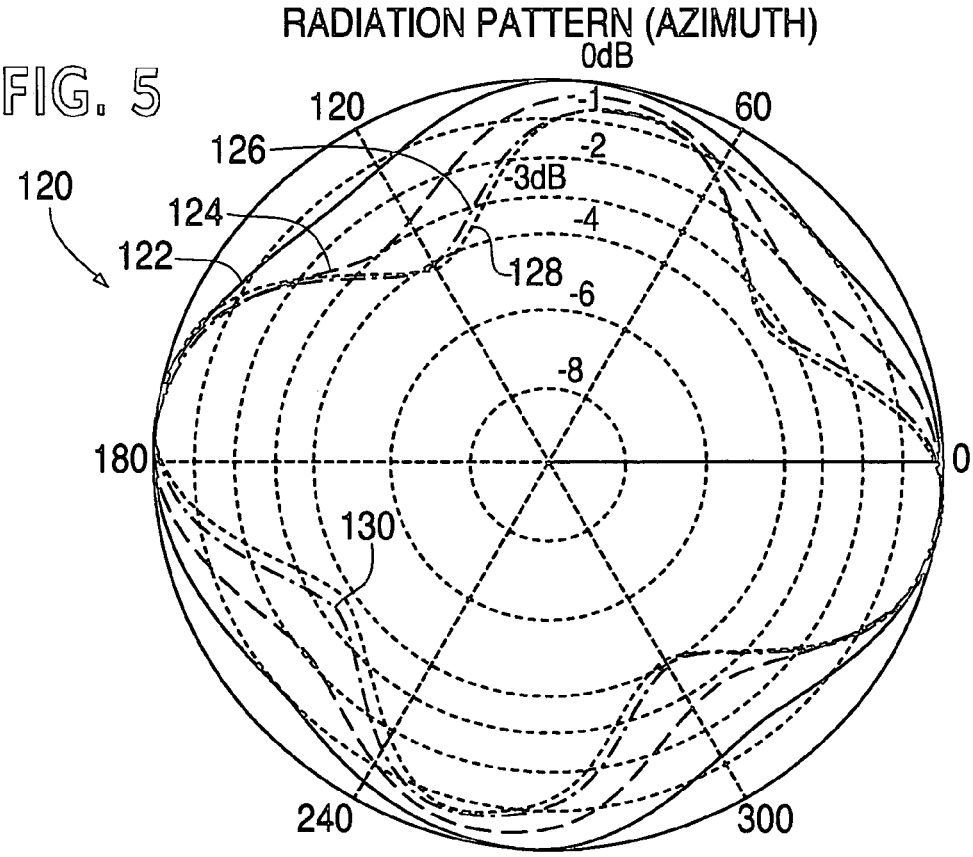
FIG. 5 is a chart indicating signal strength versus azimuth and frequency for a crossed bowtie slot antenna incorporating the instant invention.

FIG. 4 shows a chart 100 of signal strength for the horizontally polarized component of a transmitted signal versus azimuth and frequency for a single-bay crossed bowtie slot antenna without parasitic dipoles according to the '730 patent, namely, the antenna shown in FIG. 2. FIG. 5 shows a corresponding chart 120 for an equivalent antenna incorporating four parasitic dipoles 12 according to the instant invention, as shown in FIG. 3.

The charts in FIGS. 4 and 5 are theoretical data verified using full-scale prototypes. The working bandwidth for the target product is on the order of one-half octave, and could potentially be used for some combination chosen from roughly 50 television channels within that bandwidth, provided total power capability is not exceeded. This implies that a combination of number of signals and strength of each signal is limited by factors such as interelectrode distances for voltage breakdown, insulator dissipation factors, service access for removing conductive contaminants, and the like.

In FIG. 4, the signal strength versus azimuth curves 102, 104, 106, and 108 correspond to signals at the low end, midband, a high intermediate frequency, and the top end frequency, respectively. As is evident from FIG. 4, a typical intermediate-point signal null 110 leaves circularity at the low end within about −1.2 dB in the data shown, while a corresponding null 112 at the top end degrades to about −5.3 dB worst case for the apparatus shown.

In FIG. 5, the corresponding results with parasitic dipoles according to the instant invention are shown. Signal strength versus azimuth curves 122, 124, 126, and 128 for the same frequencies are seen to be largely unaffected by the presence of the dipoles at the low end 122, and to show improvement in null magnitude 130 to about −4.2 dB worst case for the top end signal 128.

Figure 6:
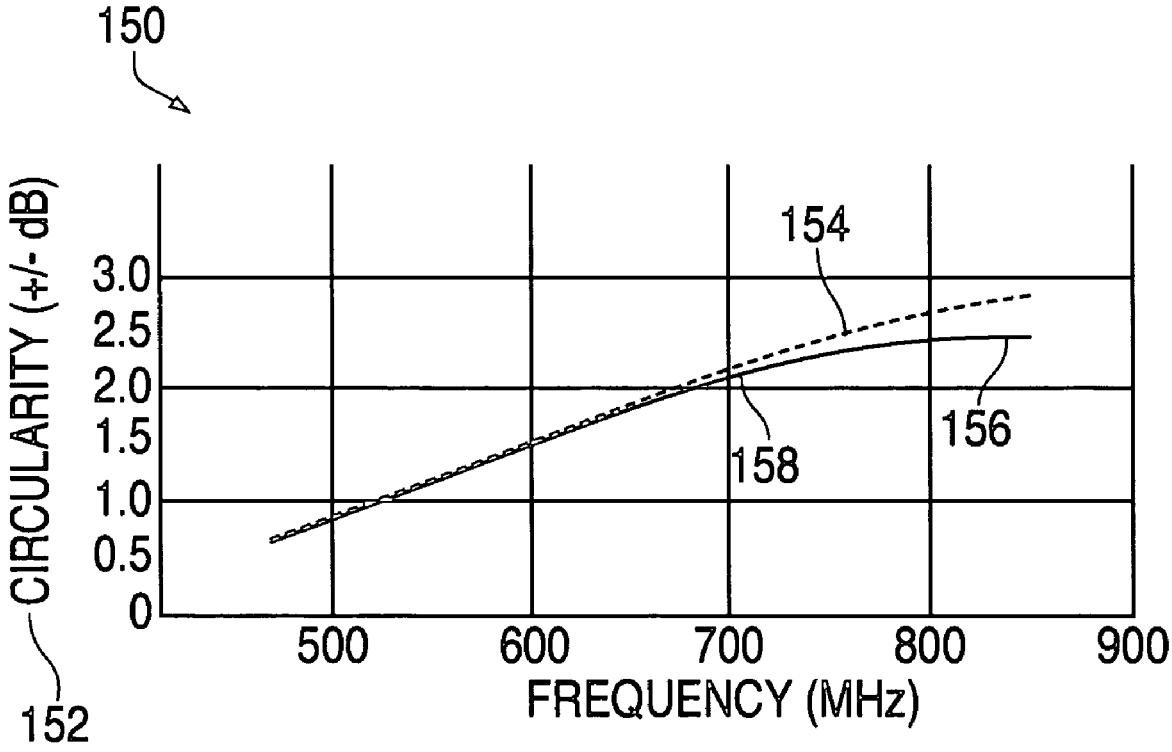
FIG. 6 is a summary graph comparing circularity versus frequency for the two antennas.

FIG. 6 is a graphical summary 150 of performance of a two-bay crossed bowtie slot transmitting antenna with single parasitic dipoles centered in all of the quadrant gaps 54 of the bay center planes 42 as shown in FIG. 1. The term "circularity" 152 on the ordinate axis indicates a normalized figure of merit ((min+max)/2, in dB) known in the art. As indicated in FIG. 6, circularity is commonly represented with greater deviations upward, so that an ideal antenna would have a flat characteristic curve along the horizontal axis. For the antenna according to the '730 patent, shown by the dashed curve 154, circularity is seen to exhibit a slight flattening of slope with increasing frequency. For the antenna with single parasitics in all positions according to the instant invention, however, the solid curve of circularity 156 shows that a significant knee 158 is forced in the curve 156, and the top end value is significantly more circular than the '730 antenna.

Extended capability may be realized through use of multiple parasitics 12 in each quadrant 54 of each antenna bay 40, with the parasitics 12 varying in length to interact more strongly with individual broadcast channel signals rather than being tuned to the top end frequency. Where multiple parasitics 12 are used, each may have an optimum location, such as a distance from the antenna central axis 70, that is a function of frequency. It may be desirable in some embodiments to position particular parasitics 12 away from the center plane of radiation 42 of the bays 40 wherein they are installed, for example to reduce interaction between parasitics 12. In still other embodiments, a plurality of parasitics 12 per bay quadrant 54, with the parasitics 12 having a common length and different displacement and/or orientation, may provide further null reduction.

As suggested above, parasitic 12 diameter may be increased to lower so-called quality factor or "Q," that is, to reduce performance at a specific frequency while widening the effective frequency range. Similarly, parasitic 12 shape and material choice can affect overall performance, such as preventing sharp edges and corners to reduce corona effects in some application environments, choosing materials with a specific electrical conductivity to influence skin depth for the frequency band required, selecting materials for thermal characteristics, and the like.

While the method presented in the instant invention has been demonstrated to be useful for frequencies in UHF television broadcasting, it is to be understood that the same concepts are applicable to signals over a considerably broader range than this. Likewise, while the application shown is concerned with broadcast RF transmitting, the concept is applicable to transceiver and receiver-only applications as well.

Figure 7:
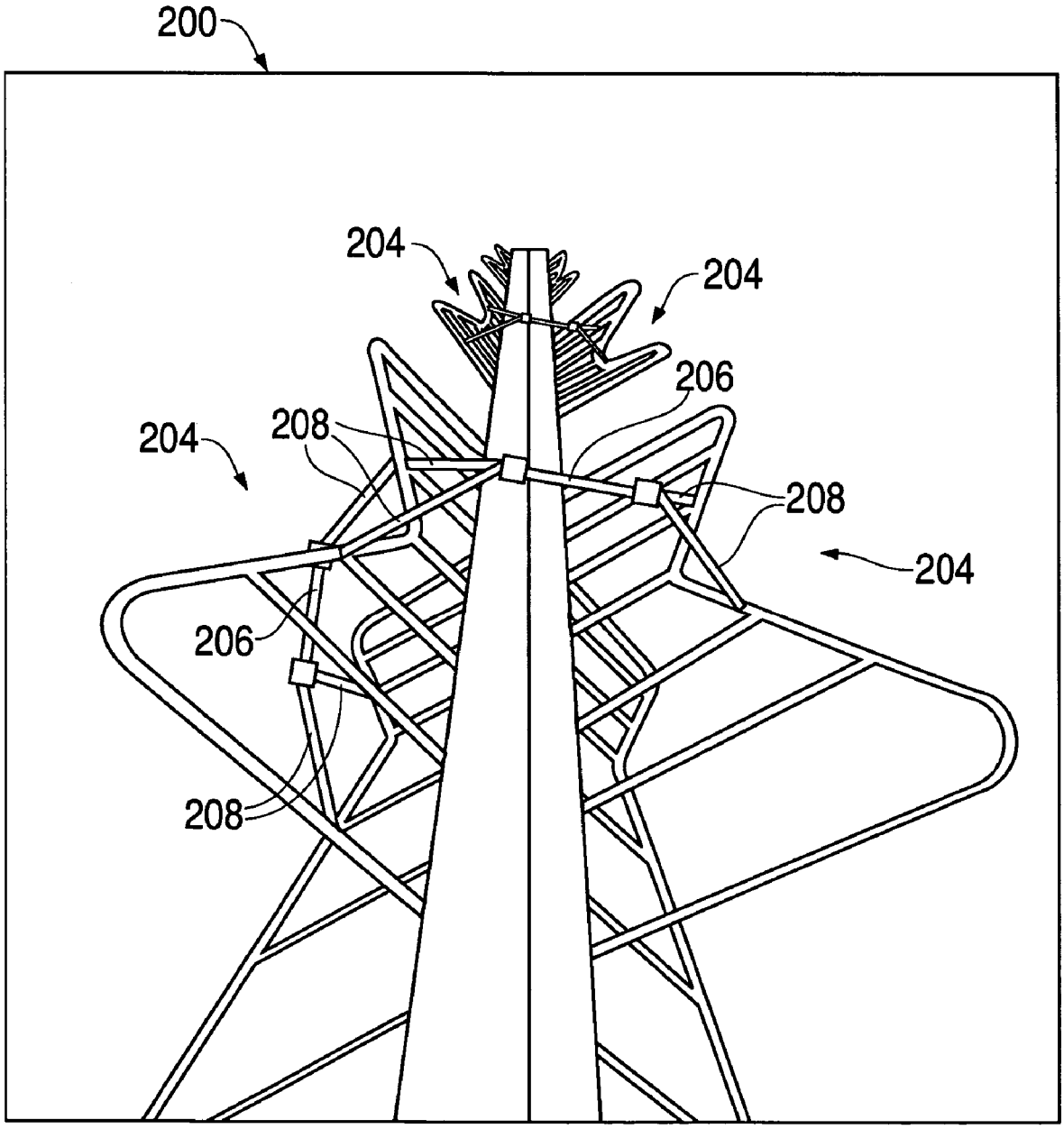
FIG. 7 is a perspective view of a batwing antenna incorporating the instant invention.

The apparatus and method of the instant invention are illustrated herein with an emphasis on application to crossed bowtie slot antennas disclosed in the '730 patent. However, several other known transmitting antenna styles exhibit characteristics similar to (and related to) the characteristics of antennas according to the '730 patent. For example, the well-known and widely installed batwing or "supertunstile" antennas, an example of which 200 is shown in FIG. 7, are commonly fed with a mode 1 (90 degree phase progression around the tower per wing for four-wing styles) pattern of emission to provide a radiating field that is relatively but imperfectly uniform with azimuth. Successive bays 204 may be series or branch fed as appropriate. For a batwing antenna, parasitic dipole radiators 206, shown mounted on nonconductive standoffs 208, can be used to couple signal from the nodes into the nulls, further improving circularity. Slotted coax and other antenna styles with identifiable nodes and nulls of emission may likewise benefit from parasitic dipole radiators, either to render emission patterns more nearly omnidirectional or to suppress emission in selected directions.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A transmitting antenna assembly, comprising:

a plurality of crossed bowtie slot antenna bays, each antenna bay including:

a plurality of blade segments arranged orthogonally to form quadrants, and a plurality of parasitic dipoles insulatively mounted to the plurality of blade segments, each parasitic dipole disposed across a quadrant to increase azimuthal uniformity of a radiation pattern of the antenna assembly; and a hybrid/power divider including a signal input port and a plurality of signal output ports, each signal output port coupled to a respective blade segment pair within the antenna bays.

2. The transmitting antenna assembly of claim 1, wherein electromagnetic radiation emitted therefrom exhibits a frequency-dependent pattern of signal strength versus azimuth.

3. The transmitting antenna assembly of claim 1, wherein improvement to antenna azimuthal uniformity by the parasitic dipole increases with frequency.

4. The transmitting antenna assembly of claim 3, further comprising a batwing antenna configuration, wherein each parasitic dipole is positioned within a respective radiation pattern of the batwing antenna configuration, wherein the parasitic dipole reinforces signal strength in an azimuth-dependent signal strength null, wherein an extent of reinforcement is a positive function of signal frequency.

5. The transmitting antenna assembly of claim 1, wherein the plurality of blade segments form crossed bowtie slot radiators.

6. The transmitting antenna assembly of claim 5, wherein each parasitic dipole is positioned within a radiation pattern of a respective crossed bowtie slot radiator.

7. The transmitting antenna of claim 6, wherein the parasitic dipole reinforces signal strength in an azimuth-dependent signal strength null, wherein an extent of reinforcement is a positive function of signal frequency.

8. The transmitting antenna assembly of claim 6, further comprising a radome-type shell substantially enclosing radiative components of the antenna.

9. The transmitting antenna assembly of claim 5, wherein each signal output port is connected to a pair of edges of a slot within a respective crossed bowtie slot radiator.

10. The transmitting antenna assembly of claim 1, wherein the parasitic dipoles are mounted to the plurality of blade segments using a pair of end cups, each enclosing at least a portion of a respective end of the parasitic dipole.

11. The transmitting antenna assembly of claim 1, wherein the hybrid/power divider converts at least one signal from the signal input port to a plurality of output signals approximately equal in power.

12. The transmitting antenna assembly of claim 11, wherein the hybrid/power control divider adjusts the phase of the signal on each signal output port to produce an omnidirectional antenna transmission pattern, whereby azimuthally aligned signal nodes radiating from the plurality of antenna bays differ by substantially 360 times n degrees, where n is an integer.

13. A method for transmitting electromagnetic signals with improved azimuthal uniformity over a frequency range, comprising the steps of:

emitting electromagnetic radiation from at least one crossed bowtie slot antenna bay of an antenna, the antenna bay including a plurality of blade segments orthogonally arranged to form quadrants, wherein the electromagnetic radiation emitted therefrom exhibits a frequency-dependent pattern of signal strength versus azimuth, wherein a substantially planar surface of maximum emission is emitted therefrom; and altering the pattern of emitted radiation by insulatively mounting a plurality of parasitic dipoles to the plurality of blade segments, each parasitic dipole disposed across a quadrant, to increase azimuthal uniformity of the radiation pattern over at least a portion of the frequency range of the antenna.

14. The transmitting method of claim 13, wherein the antenna is configured with crossed bowtie slots as the radiative elements in the at least one bay, wherein each parasitic dipole has a longitudinal axis, wherein the longitudinal axis of the dipole lies generally in the substantially planar surface of maximum emission of the at least one bay, wherein a construction line, lying in the surface, passing through a common center of the radiative elements, and bisecting a quadrant defined by the planes of the radiative elements, bisects the longitudinal axis of the dipole perpendicular thereto.

15. The transmitting method of claim 14, wherein the parasitic dipole is configured with a length approximating one half wavelength of the highest signal frequency for which the antenna is intended, and wherein the parasitic dipole is mounted using electrically isolating mounting provisions.

16. The transmitting method of claim 15, wherein a first end of the parasitic dipole is engaged using a substantially nonconductive material, wherein the material has a desired combination of mechanical stability, dielectric constant, voltage withstand, and manufacturability, and wherein a second end of the parasitic dipole is engaged using a method largely identical to that used for engaging the first end thereof.

17. The transmitting method of claim 13, wherein the parasitic dipole is configured to reinforce signal strength in an azimuth-dependent signal strength null, wherein an extent of reinforcement is a positive function of signal frequency.

18. A transmitting antenna assembly, comprising:

a plurality of crossed bowtie slot antenna bays, each antenna bay including:

means for emitting electromagnetic radiation, wherein the electromagnetic radiation emitted exhibits a frequency-dependent pattern of signal strength versus azimuth, wherein a substantially planar surface of maximum wave emission is emitted therefrom, and means for parasitically altering a radiation pattern of the means for emitting; and a hybrid/power divider including a signal input port and a plurality of signal output ports, each signal output port coupled to a respective means for emitting within the antenna bays, wherein the means for emitting emits in the form of a plurality of signal nodes, wherein phase progression in successive nodes achieves 360 degrees around the antenna over the plurality of nodes, wherein the parasitically altered radiation is directed toward at least one internodal null, wherein the means for parasitically altering lies generally in the substantially planar surface of maximum wave emission, wherein a construction line, lying in the surface, passing through a common center of the means for emitting, and bisecting a quadrant defined by the planes of the means for emitting, bisects a longitudinal axis of the means for emitting perpendicular thereto, and wherein the means for parasitically altering exhibits a frequency-dependent pattern of signal strength.

19. A crossed bowtie slot antenna bay for a transmitting antenna, comprising:

a plurality of blade segments orthogonally arranged to form quadrants; and a plurality of parasitic dipoles insulatively mounted to the plurality of blade segments, each parasitic dipole disposed across a quadrant to increase azimuthal uniformity of a radiation pattern of the antenna.

* * * * *